US006232611B1

(12) United States Patent
Suzuki et al.

(10) Patent No.: US 6,232,611 B1
(45) Date of Patent: May 15, 2001

(54) RADIOGRAPHIC INTENSIFYING SCREEN

(75) Inventors: Yujiro Suzuki; Yuji Aoki; Akio Umemoto, all of Odawara; Masamichi Itabashi, Kaisei-machi, all of (JP)

(73) Assignees: Fuji Photo Film Co., Ltd., Minamiashigara; Kasei Optonix, Ltd., Tokyo, both of (JP)

( * ) Notice: Subject to any disclaimer, the term of this patent is extended or adjusted under 35 U.S.C. 154(b) by 695 days.

(21) Appl. No.: 08/581,424

(22) Filed: Dec. 29, 1995

(30) Foreign Application Priority Data

Jan. 5, 1995 (JP) ..... 7-000143

(51) Int. Cl.[7] ..... G21K 4/00

(52) U.S. Cl. ..... 250/483.1

(58) Field of Search ..... 250/483.1, 484.4, 250/487.1, 488.1

(56) References Cited

U.S. PATENT DOCUMENTS

| | | | | |
|---|---|---|---|---|
| 4,741,993 | * | 5/1988 | Kano et al. | 250/484.4 XE |
| 5,023,461 | * | 6/1991 | Nakazawa et al. | 250/487.1 X |
| 5,164,224 | * | 11/1992 | Kojima et al. | 250/483.1 X |
| 5,227,253 | * | 7/1993 | Takasu et al. | 250/483.1 X |
| 5,477,053 | * | 12/1995 | Umemoto et al. | 250/483.1 |

* cited by examiner

*Primary Examiner*—Constantine Hannaher
(74) *Attorney, Agent, or Firm*—Oblon, Spivak, McClelland, Maier & Neustadt, P.C.

(57) ABSTRACT

A radiographic intensifying screen having at least a fluorescent layer and a protective layer on a support, wherein the protective layer has a multi-layer structure comprising at least one layer of an organic macromolecule film and a film-forming resin layer provided on the surface of the organic macromolecule film at least on the side which is not in contact with the fluorescent layer, and the resin of the film-forming resin layer is different from the resin of the organic macromolecule film.

8 Claims, 1 Drawing Sheet

RADIOGRAPHIC INTENSIFYING SCREEN

BACKGROUND OF THE INVENTION

1. Field of the Invention

The present invention relates to a radiographic intensifying screen (hereinafter referred to as "intensifying screen"). More particularly, the present invention relates to an intensifying screen excellent in durability.

2. Discussion of Background

An intensifying screen is used in intimate contact with an X-ray film in order to improve sensitivity of photographing in the field of medical radiographing for medical diagnosis or of industrial radiographing for non-destructive inspection of materials. Generally, on the surface of the intensifying screen, there are made abrasions or defects by an X-ray film, or dirt is attached thereon. Also, the surface of the intensifying screen is often damaged by contaminants including dust entered between the intensifying screen and the X-ray film, and also chemical materials contained in cleaners for the intensifying screen and the X-ray film are sometimes invaded into the intensifying screen to stain or color the screen. The above-mentioned various defects and damages cause unusual artifacts on a radiograph or make sensitivity lower. In order to prevent the performance of the intensifying screen from deteriorating, it is usual to provide a transparent protective layer on the surface of the intensifying screen which is brought into direct contact with an X-ray film.

Heretofore, in a method for forming a protective layer, a protective layer-forming coating solution having an appropriate viscosity is prepared by dissolving cellulose derivatives such as cellulose acetate, nitro cellulose and cellulose acetate butyrate, polyvinyl chloride, polyvinyl acetate, vinyl chloride-vinyl acetate copolymer, polycarbonate, polyvinyl butyral, polymethyl methacrylate, polyvinyl formal, polyurethane or other resins in a solvent, and the coating solution thus prepared is coated on a previously formed fluorescent layer and dried to form a protective layer thereon. Alternatively, a protective layer previously formed in the form of a film, such as an organic macromolecule film including polyethylene terephthalate, polyethylene, polyvinylidene chloride, polyamide and the like, may be laminated on a fluorescent layer to form a protective layer.

It is useful for improving durability of an intensifying screen to make a protective layer thick, but if the thickness of the protective layer increases, sharpness is lowered, and therefore it has been difficult to improve both durability and image quality at the same time.

As a method for improving durability and handling property of an intensifying screen or a radiation image-conversion panel using an photostimulable phosphor, Japanese Unexamined Patent Publication No. 310900/1992, Japanese Unexamined Patent Publication No. 309898/1992 and Japanese Unexamined patent Publication No. 75097/1994 disclose a protective layer formed on the surface of a fluorescent layer by coating a protective layer-forming coating solution containing an organic solvent-soluble fluorocarbon resin having a polysiloxane-structured oligomer, a perfluoroalkyl group-containing oligomer, a perfluoroolefin resin powder or a silicone resin powder added therein.

Among these protective layer-forming methods, when a coating solution prepared by dissolving a protective layer-forming resin in a solvent is coated on a fluorescent layer, a part of the coating solution is soaked into the inside of the fluorescent layer and accordingly a protective layer is formed on the fluorescent layer without making a boundary between the two layers. Thus, the protective layer is firmly bonded with the fluorescent layer, and peeling of the protective layer off the intensifying screen and occurrence of pinholes on the protective layer due to the presence of contaminants can be avoided. Also, when the above-mentioned organic solvent-soluble fluorocarbon resin is used as a protective layer-forming resin, anti-fouling property is improved and a coefficient of friction is lowered, thereby improving durability resistance. Further, since a contact angle between water and the resin is large, even if pinholes are produced, a chemical material from an X-ray film is hardly soaked and spot-like sensitivity degradation does not substantially occur, thus improving pinhole resistance.

However, when a protective layer is formed by coating a solution, a starting material used is limited to a solvent-soluble resin, and accordingly durability resistance is poor as compared with a method wherein an organic macromolecule film such as polyethylene terephthalate is laminated on a fluorescent layer to form a protective layer. Further, when a binder resin content in a fluorescent layer is reduced in order to improve sharpness, a protective layer-forming coating solution is soaked into the fluorescent layer when the protective layer-forming coating solution is coated on the fluorescent layer, and a protective layer having a sufficient thickness can not be formed. On the other hand, when a protective layer-forming coating solution is coated in a large amount on a fluorescent layer in order to form a protective layer having a sufficient thickness, the protective layer-forming coating solution is soaked into the fluorescent layer, thereby causing such problems as lowering sharpness or generating foams during coating.

Unlike the method for forming a protective layer by coating a solution, in the method for forming a protective layer by laminating an organic macromolecule film on a fluorescent layer, there is caused no problem of soaking with a protective layer-forming coating solution. Particularly when a polyethylene terephthalate film is used as a protective layer to be laminated, as compared with the method of using a protective layer-forming coating solution, abrasion resistance and solvent resistance are excellent and water vapor permeability and gas permeability are low, thereby providing excellent anti-staining property to a chemical material eluded from an X-ray film. However, as compared with a protective layer formed by coating a solution, adhesive strength of a protective layer laminated on a fluorescent layer is poor and therefore the laminated protective layer is liable to be peeled and pinholes are liable to occur when contaminants invade into between an intensifying screen and an X-ray film. Further, through the pinholes, various contaminants invade into the intensifying screen, thereby causing a problem of producing spot-like sensitivity degradation parts.

Thus, both a protective layer formed by coating a solution on a fluorescent layer and a protective layer formed by laminating an organic macromolecule film on a fluorescent layer respectively provide various advantages and disadvantages, and it has been difficult to satisfy all of requirements.

Also, recently, radiographing is automatically conducted in a labor saving manner, and an X-ray film is automatically conveyed and charged into a radiographing apparatus. Further, a film changer for automatically taking an X-ray film after radiographing and a film-conveying apparatus of a cassetteless X-ray TV are often used. Under these recent circumstances, an intensifying screen is demanded to be more improved in respect of anti-staining property, handling properties including an X-ray film-conveying property, and the like.

An object of the present invention is to provide an intensifying screen which satisfies satisfactory image quality, durability and handling performances at the same time.

In order to improve durability and handling performances of an intensifying screen without degrading image quality, the present inventors have studied about materials used for a protective layer of an intensifying screen and its structure, and have found that the material quality and the structure of the protective layer are closely related to durability and handling performances of the intensifying screen. The present invention is made on the basis of this finding.

SUMMARY OF THE INVENTION

The present invention provides a radiographic intensifying screen having at least a fluorescent layer and a protective layer on a support, wherein the protective layer has a multi-layer structure comprising at least one layer of an organic macromolecule film and a film-forming resin layer provided on the surface of the organic macromolecule film at least on the side which is not in contact with the fluorescent layer, and the resin of the film-forming resin layer is different from the resin of the organic macromolecule film.

The intensifying screen having the protective layer of the above-mentioned structure is improved not only in image quality but also in pinhole resistance, anti-staining property, anti-fouling property, durability and handling performances including X-ray film-conveying performance, and the like.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Figure 1:
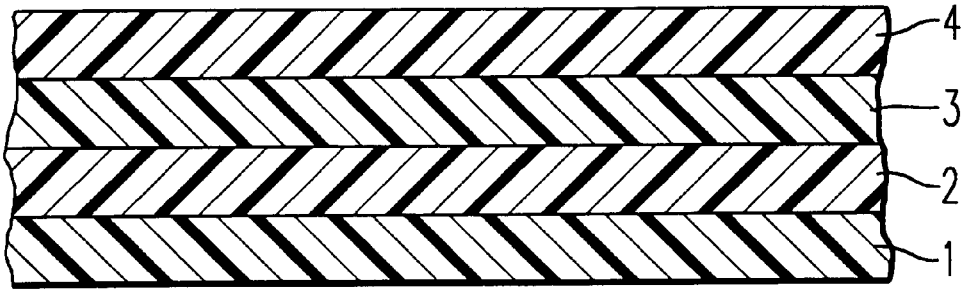
FIG. 1 is a cross-section of a radiographic intensifying screen of the present invention.

Hereinafter, the present invention is further explained in more detail.

FIG. 1 is a cross-section of a radiographic intensifying screen, which illustrates an embodiment of the invention. In this FIG., 1 is a support, 2 is a flourescent layer, and 3 and 4 form a protective layer, wherein 3 is an organic macromolecule film and 4 is a film-forming resin layer.

In a general method for producing the intensifying screen of the present invention, a fluorescent layer is formed by mixing a predetermined amount of phosphor with a binder such as nitro cellulose, adding an organic solvent to the mixture to form a phosphor-coating solution having an appropriate viscosity, coating the phosphor-coating solution on a support by a knife coater, a roll coater or the like and drying the support thus coated.

The intensifying screen of the present invention may have a light-reflecting layer, a light-absorbing layer or a metal foil layer between the fluorescent layer and the support. In such a case, the support is previously provided with the light-reflecting layer, the light-absorbing layer or the metal foil layer, and the above-mentioned phosphor-containing solution is coated thereon and is dried to form a fluorescent layer. Also, it is preferable to provide an electroconductive layer on the back side of the support or between the support and the fluorescent layer, thus achieving a antistatic effect without coating an antistatic agent on the surface. Such an electroconductive layer can be formed by directly coating an organic electroconductive material or an inorganic electroconductive material such as ZnO, $SnO_2$, $In_2O_3$ and carbon, or dispersing electroconductive materials in a binder and coating the dispersion. It is preferable to adjust electroconductivity of the electroconductive layer so as to provide a surface resistance value of from $10^7$ to $10^{13}$ Ω after forming the electroconductive layer.

Examples of the support used for the intensifying screen of the present invention include a film of cellulose acetate, cellulose propionate, cellulose acetate-butyrate, polyester such as polyethylene terephthalate or the like, polystyrene, polymethylmethacrylate, polyamide, polyimide, vinyl chloride-vinyl acetate copolymer, polycarbonate, or the like, bulk board paper, resin-coated paper, ordinary paper, aluminum alloy foil, and the like. When the above-mentioned plastic films or papers are used as a support for the intensifying screen of the present invention, a light-absorbing material such as carbon black or a light-reflecting material such as titanium dioxide and calcium carbonate may be previously kneaded therein. As a phosphor for the intensifying screen of the present invention, any phosphor can be used, provided that it emits light by X-ray excitation, examples of which include $Gd_2O_2S$:Tb, $Y_2O_2S$:Tb, $(Gd,Y)_2O_2S$: Tb, $La_2O_2S$:Tb, $(Gd,Y)_2O_2S$:Tb:Tm, $GdTaO_4$:Tb, $Gd_2O_3.Ta_2O_5.B_2O_3$:Tb, $CaWO_4$, $BaSO_4$:Pb, LaOBr:Tm, LaOBr:Tb, $HfO_2$:Ti, $HfP_2O_7$:Cu, $CdWO_4$, $YTaO_4$, $YTaO_4$:Tm, $YTaO_4$:Nb, ZnS:Ag, BaFCl:Eu and the like.

A binder used for the intensifying screen of the present invention is not especially limited, and conventionally known binders for an intensifying screen can be used, examples of which include nitro cellulose, cellulose acetate, ethylcellulose, polyvinyl butyral, linear polyester, polyvinyl acetate, vinylidene chloride-vinyl chloride copolymer, vinyl chloride-vinyl acetate copolymer, polyalkyl (meth)acrylate, polycarbonate, polyurethane, cellulose acetate butyrate, polyvinyl alcohol, gelatin, polysaccharide such as dextrin, gum arabic, and the like.

An amount of a binder remaining in a fluorescent layer is from 1 to 10 parts by weight as a solid content to 100 parts by weight of a phosphor in view of sharpness, and more preferably from 1 to 6 parts by weight as a solid content to 100 parts by weight of a phosphor.

Examples of an organic solvent used in the preparation of a phosphor-coating solution include ethanol, methylethyl ether, butyl acetate, ethyl acetate, ethyl ether, xylene and the like. Further, if necessary, the phosphor-coating solution may contain a dispersing agent such as phthalic acid or stearic acid and a plasticizer such as triphenylphosphate or diethylphthalate.

Hereinafter, a protective layer used for the intensifying screen of the present invention is further explained in more details.

The protective layer of the present invention comprises an organic macromolecule film, at least one side of which is provided with a thin film-forming resin layer of a resin different from the resin constituting the organic macromolecule film, the film-forming resin layer being adhered to the organic macromolecule film by heat-transferring a previously made thin film-forming resin film to the organic macromolecule film or by bonding the previously made thin film-forming resin film to the organic macromolecule film by way of an adhesive layer. Alternatively, a solution containing a film-forming resin is coated on the organic macromolecule film and is dried to form a film-forming resin layer. In order to obtain a uniform thin film-forming resin layer, it is preferable to employ the latter method, i.e. a resin layer-forming method using a coating solution containing the film-forming resin. The film-forming resin layer may be previously formed on an organic macromolecule film before the organic macromolecule film is provided on a fluorescent layer or it may be formed on the organic macromolecule film after the organic macromolecule film is provided on the fluorescent layer.

It is necessary that the film-forming resin layer is provided on at least one side of the organic macromolecule film, which is not in contact with the fluorescent layer, but it may be provided on both sides of the organic macromolecule film. However, in view of sharpness of the finally obtained intensifying screen, it is preferable to make the protective layer as thin as possible, and accordingly it is preferable to form the film-forming resin layer only on the side of the organic macromolecule film, which is not in contact with the fluorescent layer.

The organic macromolecule film itself may have a multi-layer structure. As generally conducted, an adhesive layer such as a heat-sensitive adhesive layer of a polyester type adhesive is provided on both sides or on the side of the organic macromolecule film, which is brought into contact with the fluorescent layer, and the organic macromolecule film layer is formed on the fluorescent layer by a laminating method. This is a preferable method.

Preferable examples of a resin for constituting the organic macromolecule film of the present invention include polyethylene terephthalate, polyethylene naphthalate, aramide, polyethylene, polyvinylidene chloride, polyamide and the like. More preferable examples include polyethylene terephthalate, polyethylene naphthalate and aramide.

The organic macromolecule film of the present invention has preferably a thickness of from 1 to 10 $\mu$m, more preferably from 1.5 to 7 $\mu$m, most preferably from 2 to 5 $\mu$m. In order to strengthen the adhesive force with the film-forming resin layer, the surface of the organic macromolecule film to be adhered may be activated by surface treatment.

Preferable examples of a resin used as the film-forming resin layer of the intensifying screen of the present invention include cellulose derivatives such as cellulose acetate, nitro cellulose and cellulose acetate butyrate, polyvinyl chloride, polyvinyl butyral, polyvinyl acetate, vinyl chloride-vinyl acetate copolymer, polymethylmethacrylate, polycarbonate, polyvinyl formal, polyurethane, solvent-soluble fluorocarbon resin, polyacryl, and the like.

It is preferable to incorporate a crosslinking agent, a crosslinking-accelerating agent (catalyst) or the like in the film-forming resin layer.

The film-forming resin layer of the intensifying screen of the present invention may have a multi-layer structure, and accordingly it is preferable to provide an adhesive layer when adhesiveness with the organic macromolecule film is insufficient and/or to provide a plastic layer in order to relax stress concentrated on the protective layer.

The film-forming resin layer which is a part of the protective layer of the intensifying screen of the present invention, has preferably a thickness of from 0.1 to 5 $\mu$m, more preferably from 0.3 to 4 $\mu$m, most preferably from 0.5 to 3 $\mu$m.

In the film-forming resin layer of the intensifying screen of the present invention, the uppermost resin layer (which is brought into contact with an X-ray film when using) should preferably contain a surface-modifying agent such as a polysiloxane structure-containing oligomer, a perfluoroalkyl group-containing oligomer or the like in order to improve abrasion resistance, anti-staining property and anti-fouling property, and further to impart a satisfactory intimate contact with an X-ray film and a satisfactory slipping property for improving releasing property, and still further to make a contact angle to water larger. The amount of the surface-modifying agent varies depending on a degree of achievement of the above aimed effect, but is generally not more than 10 wt % of the film-forming resin layer, preferably not more than 5 wt %.

Various combinations of the organic macromolecule film and the film-forming resin layer with regard to the protective layer of the present invention can be considered, but it is preferable to use polyethylene terephthalate, polyethylene naphthalate, or aramide as an organic macromolecule film-constituting resin and to use fluorocarbon resin as a film-forming resin layer-constituting resin in order to improve durability, anti-fouling property or the like of the intensifying screen. It is particularly preferable to add a polysiloxane structure-containing oligomer or a perfluoroalkyl group-containing oligomer to the fluorocarbon resin.

The thickness of the protective layer of the intensifying screen of the present invention is preferably thin in view of sharpness, but preferably thick in view of physical durability. In practice, it is preferable to adjust the thickness of the total protective layer comprising plural layers containing a film-forming resin layer in the range of from 2 to 10 $\mu$m in order not only to satisfy physical durability but also to prevent sharpness from deteriorating.

The intensifying screen of the present invention prepared as mentioned above, is excellent in image quality, durability and handling properties as compared with conventional intensifying screens obtained by forming protective films by laminating conventional organic macromolecule films or by coating protective layer-forming coating solutions.

EXAMPLE

The present invention is further illustrated by the following Examples but should not be limited thereto.

EXAMPLE 1

A phosphor coating solution was prepared by mixing 10 parts by weight of $Gd_2O_2S$:Tb phosphor having an average particle size of 5.0 $\mu$m, 1 part by weight of vinyl chloride-vinyl acetate copolymer (binder) and ethyl acetate as an organic solvent.

The above prepared phosphor coating solution was coated on a support comprising a polyethylene terephthalate film of 250 $\mu$m thickness having titanium dioxide kneaded therein, which had been previously coated with a ZnO whisker particle layer of 20 $\mu$m thickness as an electroconductive layer. The above phosphor coating solution was uniformly coated in such an amount as to provide a dry phosphor coating weight of 50 mg/cm$^2$ by a knife coater, and was dried to form a phosphor layer.

Thereafter, a protective layer-forming resin solution having 80 parts by weight of a fluorocarbon resin ("Lumiflon LF 100C" manufactured by Asahi Glass Company Ltd.), 15 parts by weight of a crosslinking agent (isocyanate, a curing agent for "Lumiflon LF 100C" manufactured by Asahi Glass Company Ltd.) and 5 parts by weight of an alcohol-modified silicone oligomer ("X-22-2809" manufactured by Shin-Etsu Kagaku Kogyo Co.) dissolved in methyl ethyl ketone was coated on a polyethylene terephthalate film of 4.5 μm thickness in such an amount as to provide a dry coating thickness of 1.5 μm by a knife coater, thus producing a protective layer having a two-layer structure. Further, a polyester type adhesive agent was coated in such an amount as to provide 0.5 μm on the side, to which the fluorocarbon resin was not coated, and was dried.

Thereafter, the above protective layer was heat-laminated by way of the adhesive layer on the above formed phosphor layer to produce an intensifying screen.

EXAMPLE 2

An intensifying screen (2) was obtained in the same manner as in Example 1, except that a polyethyl naphthalate film having the same thickness was used in place of the polyethylene terephthalate of 4.5 μm thickness in the preparation of the protective layer.

EXAMPLE 3

An intensifying screen (3) was obtained in the same manner as in Example 1, except that the alcohol-modified silicone oligomer was not added to the protective layer-forming coating solution.

EXAMPLE 4

An intensifying screen (4) was obtained in the same manner as in Example 1, except that a polyurethane resin (tradename, "Desmolac 4125" manufactured by Sumitomo Bayer Urethane Company) was used in place of the fluorocarbon resin as a film-forming resin and the amount of the alcohol-modified silicone oligomer was increased to 7 parts by weight.

COMPARATIVE EXAMPLE

A comparative intensifying screen (R1) was prepared in the same manner as in Example 1, except that a protective layer comprising only a polyethylene terephthalate film of 6 μm thickness having a polyester type adhesive coated in 0.5 μm thickness was laminated, as a protective layer on the phosphor layer formed on the support in the same manner as in Example 1, in place of the polyethylene terephthalate, one side of which was provided with the fluorocarbon resin layer.

Further, a comparative intensifying screen (R2) was prepared in the same manner as in Example 1, except that a protective layer-forming coating solution of the fluorocarbon resin as mentioned in Example 1 was directly coated by a knife coater so as to provide a dry coating thickness of 6 μm, as a protective layer on the phosphor layer formed on a support in the same manner as in Example 1, in place of the polyethylene terephthalate film, one side of which was provided with the fluorocarbon resin layer.

TEST EXAMPLE

With regard to the above prepared intensifying screens (1) to (4) of Examples 1 to 4 and the comparative intensifying screens (R1) and (R2) of Comparative Example, radiographic properties (sensitivity and sharpness) were measured by using orthochromatic films ("Super HR-S30" manufactured by Fuji Photo Film Co., Ltd.), and also abrasion resistance, pinhole resistance, anti-staining property and anti-fouling property were evaluated, and the results are shown in the following Table 1. The respective evaluation method and evaluated values are explained below.

Sensitivity; Expressed by relative value as compared with the sensitivity of the intensifying screen (R1) of Comparative Example which is determined as 100.

Sharpness: MTF value of each intensifying screen was measured at a spatial frequency of 2.0 LP/mm and sharpness was expressed by relative value as compared with the MTF value of the intensifying screen (R1) of Comparative Example which is determined as 100.

Abrasion resistance: Abrasion state on the surface of an intensifying screen was relatively evaluated by stroking an intensifying screen of 5 cm×5 cm square loaded with 100 g to and from at a distance of 25 cm for 5,000 times on an orthochromatic film ("Super HRS30" manufactured by Fuji Photo Film Co., Ltd.) placed on a smooth plate.

Pinhole resistance: An abrasive paper ("CC-320-CW" manufactured by Sankyo Rikagaku Kabushiki Kaisha) of 5 cm×15 cm was placed on the surface of an intensifying screen of the same size, and a load of 1 kg was applied thereon by rolling a rubber roller to cause pinholes. Thereafter, a penetrating solution ("Super check" manufactured by Tokushu Toryo Kabushiki Kaisha) was sprayed thereon and was quickly wiped off with a gauge impregnated with ethanol. The pinhole parts are colored due to the penetration of the penetrating solution, and pinhole resistance was relatively evaluated by the degree of coloring due to the penetration of the penetrating solution.

Anti-staining property: a penetrating solution ("Super Check" manufactured by Tokushu Toryo Kabushiki Kaisha) was sprayed on the surface of an intensifying screen, and the intensifying screen was allowed to stand for 1 minute and a colored degree was evaluated after wiping off the penetrating solution with a gauze impregnated with ethanol.

Anti-fouling property: A line was drawn on the surface of an intensifying screen by "DERMATOGRAPH" manufactured by Mitsubishi Empitsu Company and the drawn line was wiped off with a dry gauze to evaluate wiping-off property.

Evaluation results of abrasion resistance, pinhole resistance, anti-staining property and anti-fouling property are shown in the following Table 1.

TABLE 1

| Intensifying screen | Radiographic properties | | Abrasion resistance | Pinhole resistance | Anti-staining property | Anti-fouling property |
|---|---|---|---|---|---|---|
| | Sensitivity | Sharpness | | | | |
| (1) | 102 | 100 | ○ | ○ | ○ | ◎ |
| (2) | 102 | 100 | ○ | ○ | ○ | ◎ |
| (3) | 102 | 100 | ○ | ○ | ○ | ○ |
| (4) | 102 | 100 | ○ | ○ | ○ | ○ |

TABLE 1-continued

| Intensifying screen | Radiographic properties | | Abrasion resistance | Pinhole resistance | Anti-staining property | Anti-fouling property |
|---|---|---|---|---|---|---|
| | Sensitivity | Sharpness | | | | |
| (R1) | 100 | 100 | ○ | Δ | ○ | Δ |
| (R2) | 103 | 97 | Δ | ○ | Δ | ⊙ |

⊙: Excellent, ○: Good, Δ: Poor

As evident from the data in Table 1, the intensifying screens (1) to (4) of the present invention had radiographic properties at the same or higher level and more satisfactory pinhole resistance and anti-fouling property as compared with the comparative intensifying screen (R1), and also had radiographic properties at the same or higher level and more satisfactory abrasion resistance and anti-staining property as compared with the comparative intensifying screen (R2).

Also, the intensifying screens (1) to (4) of the present invention had conveying properties of an X-ray film, intimate contact properties with an X-ray film and releasing properties at the same level as compared with the comparative intensifying screen (R2), but these properties were more satisfactory as compared with the comparative intensifying screen (R1).

As mentioned above, the present invention provides an intensifying screen having a satisfactory radiographic image quality and also having excellent durability, anti-staining property and anti-fouling property, which is more improved in respect of conveying property of an X-ray film, intimate contact with an X-ray film and releasing property, as compared with conventional intensifying screens.

What is claimed is:

1. A radiographic intensifying screen, comprising:

a) a support;

b) a fluorescent layer on the support; and c) a protective layer on the fluorescent layer, comprising:

i) an organic macromolecule resin film provided on the fluorescent layer, and ii) a film-forming resin layer on the organic macromolecule resin film, comprising a polysiloxane oligomer or a perfluoroalkyl oligomer, wherein the film-forming resin layer comprises a resin which is different from the resin of the organic macromolecule film.

2. The radiographic intensifying screen according to claim 1, wherein the film-forming resin layer contains a fluorocarbon resin.

3. The radiographic intensifying screen according to claim 1, wherein the organic macromolecule film comprises polyethylene terephthalate, polyethylene naphthalate or aramide.

4. The radiographic intensifying screen according to claim 1, wherein the organic macromolecule film has a thickness of from 1 to 10 $\mu$m and the film-forming resin layer has a thickness of from 0.1 to 5 $\mu$m.

5. The radiographic intensifying screen according to claim 1, wherein the protective layer has a thickness of from 2 to 10 $\mu$m.

6. The radiographic intensifying screen according to claim 1, wherein the film-forming resin layer is formed by coating a solution containing the film-forming resin on the organic macromolecule film.

7. The radiographic screen of claim 1, wherein the organic macromolecule resin film is laminated to the fluorescent layer.

8. The radiographic screen of claim 1, wherein the film-forming resin is formed by applying a coating solution.

* * * * *